United States Patent [19]

Hue

[11] Patent Number: 4,792,156

[45] Date of Patent: Dec. 20, 1988

[54] SAFETY BINDING FOR CROSS-COUNTRY SKIING

[75] Inventor: Jean Hue, Annecy, France

[73] Assignee: Salomon, S.A., Annecy, France

[21] Appl. No.: 63,770

[22] Filed: Jun. 24, 1987

Related U.S. Application Data

[63] Continuation of Ser. No. 816,962, Jan. 8, 1986, abandoned, which is a continuation of Ser. No. 482,370, Apr. 5, 1983, abandoned.

[30] Foreign Application Priority Data

Aug. 4, 1982 [FR] France ..... 82 06434

[51] Int. Cl.[4] ..... A63C 9/081

[52] U.S. Cl. ..... 280/615; 280/618; 280/636

[58] Field of Search ..... 280/614, 615, 618, 620, 280/635, 636, 625, 626

[56] References Cited

U.S. PATENT DOCUMENTS

| | | | |
|---|---|---|---|
| 1,815,168 | 7/1931 | Sprague | 280/635 |
| 2,108,167 | 2/1938 | Gerber | 280/635 |
| 2,144,021 | 1/1939 | Keiner | 280/618 |
| 2,245,850 | 6/1941 | Brown | 280/635 |
| 2,383,064 | 8/1945 | Lanz | 280/618 |
| 2,534,038 | 12/1950 | Lanz | 280/618 |
| 2,545,574 | 3/1951 | French . | |
| 2,676,813 | 4/1954 | Beyl | 280/618 |
| 3,145,027 | 8/1964 | Berchtold | 280/620 |
| 3,845,964 | 11/1974 | Johnson . | |
| 3,866,928 | 2/1975 | Gertsch et al. | 280/618 |
| 3,891,226 | 6/1975 | Gertsch | 280/618 |
| 4,098,522 | 7/1978 | Beyl | 280/618 |
| 4,185,852 | 1/1980 | Himmetsberger | 280/618 |
| 4,353,576 | 10/1982 | Salomon | 280/615 |
| 4,382,611 | 5/1983 | Salomon | 280/615 |
| 4,498,687 | 2/1985 | Salomon | 280/615 |

FOREIGN PATENT DOCUMENTS

| | | | |
|---|---|---|---|
| 1428890 | 6/1969 | Fed. Rep. of Germany . | |
| 1800195 | 5/1970 | Fed. Rep. of Germany . | |
| 1728485 | 7/1973 | Fed. Rep. of Germany . | |
| 2307365 | 8/1974 | Fed. Rep. of Germany . | |
| 2329880 | 1/1975 | Fed. Rep. of Germany . | |
| 7723934 | 11/1977 | Fed. Rep. of Germany . | |
| 2937347 | 6/1980 | Fed. Rep. of Germany | 280/615 |
| 2907359 | 8/1980 | Fed. Rep. of Germany . | |
| 2907365 | 8/1980 | Fed. Rep. of Germany . | |
| 3115618 | 3/1982 | Fed. Rep. of Germany . | |
| 1166145 | 11/1958 | France . | |
| 2120468 | 8/1972 | France . | |
| 2447731 | 8/1980 | France . | |
| 88427 | 12/1936 | Sweden | 280/615 |
| 88427 | 2/1937 | Sweden . | |

*Primary Examiner*—John J. Love
*Assistant Examiner*—Everett G. Diederiks, Jr.
*Attorney, Agent, or Firm*—Sandler & Greenblum

[57] ABSTRACT

Binding assembly for a cross country ski boot, having a safety device comprising a hooking arrangement in which the forward end of the boot is retained, and lateral retaining, complementary engaging portions on the ski and in the sole of the boot. The hooking and lateral retaining devices are rigidly affixed to each other without intervening gap, and are releasable at least laterally about at least one rotational axis against the effect of a torsional retainer, whatever the elevation of the boot heel from the ski.

30 Claims, 7 Drawing Sheets

SAFETY BINDING FOR CROSS-COUNTRY SKIING

This application is a continuation of application Ser. No. 816,962, filed Jan. 8, 1986, (now abandoned) which in turn is a continuation under 37 C.F.R. 1.62 of Ser. No. 482,370 filed Apr. 5, 1983 (also abandoned).

FIELD OF THE INVENTION

The present invention relates to a binding device for a ski boot, and more particularly to a safety binding for the practice of cross-country skiing.

BACKGROUND OF THE INVENTION

The spectacular development of cross-country skiing is the basis for the considerable progress in the resources placed at the disposal of cross-country skiers, in terms of both design and of materials used.

Practitioners of cross-country skiing being more and more numerous, a fairly large percentage of the population which they represent does not necessarily have a very high sport and technical level for practising the sport with maximum ease and safety. To remedy this situation, certain manufacturers of ski equipment have thought of perfecting cross-country ski bindings enabling safety release for the purpose of liberating the ski boot from the ski in the event of falls, shocks, etc., just as in the case of downhill skiing. Such bindings are described, e.g., in German patent Nos. 2,907,359 and 2,307,365, where the forward portion of the sole of the boot is attached in a directly releasable manner with respect to the ski, either a yoke or jaw releasable with respect to the ski, the toe of the boot remaining in said jaw. As regards safety, this type of device is of clear interest, but significant disadvantages remain as regards skiability, since the front of the foot is resiliently connected to the ski, preventing precise guidance of the ski.

Also known are devices for the lateral retention of the boot on the ski. These improve the precise guidance of the ski. However, since the lateral rentention device is intended to maintain the boot on the ski, it has properties different from, if not contrary to, those required for safety release, and particularly lateral safety.

SUMMARY OF THE INVENTION

The object of the present invention is a cross-country ski binding which has contradictory properties, namely both good lateral retention and safety release during use. The present invention therefore relates to a binding for a boot to a ski intended for the cross-country ski, characterized by the fact that it comprises:

(1) A safety binding device comprising, on the one hand, hooking means in which the boot is maintained on the ski by its forward end, while permitting raising of the heel, and, on the other hand, means for laterally retaining the said boot on the ski, arranged in the region located forwardly of the said hooking means cooperating with the sole of the boot, the said hooking means and lateral retention means being rotatable about a least one axis perpendicular to the ski.

(2) Torsional retaining means located between the ski and the said device controlling all torsional movement of the boot no matter what may be its position on the ski.

BRIEF DESCRIPTION OF THE DRAWINGS

Other advantages and characteristics of the invention will appear from the following description related to the attached drawings, which are given only by way of non-limiting example, and in which.

DETAILED DESCRIPTION

Figure 1:
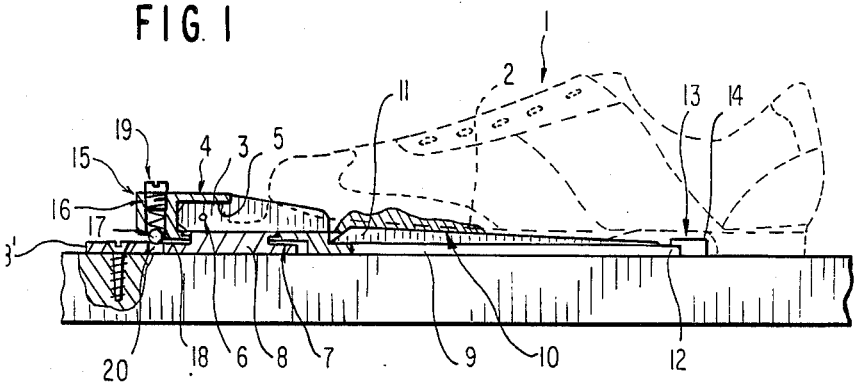
FIG. 1 is a longitudinal section view of a first embodiment of the invention.
Figure 2:
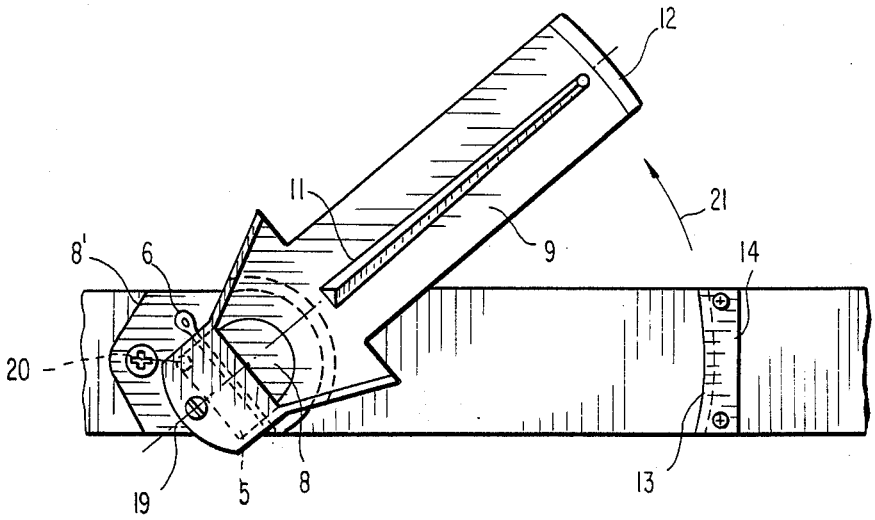
FIG. 2 is a plan view showing the operation of the first embodiment.

According to a first embodiment of the invention, illustrated by FIGS. 1 and 2, a cross-country ski boot is connected to a ski by its forward end by means of a hooking system, while lateral retaining means are arranged on the upper surface of the ski to cooperate with corresponding means in the sole of the boot. Preferably, the hooking system comprises a base plate which is extended toward the rear in order to receive the said lateral retaining means, such that they form an integral part with the hooking system, while at the front are located the means for torsional retention of the binding assembly with respect to the ski. These torsional retaining means are effective only due to the rotational pivot which is centered forwardly of the hooking system.

FIGS. 1 to 7 illustrate all the embodiments according to the invention in which the boot remains connected to the ski after it has been subjected to release torque, and more particularly when the sole of the said boot is engaged with the lateral retaining means, at least in the metatarsal region.

In this type of embodiment, FIGS. 1 and 2, the boot 1 comprises, for example, for the type of binding which is shown, a sole 2 the forward end of which comprises a flexible extension 3 engaging in the said binding 4, the latter comprising, at its forward portion, means 6 for hooking the said extension. The latter means are constituted by a housing zone 5 the lower wall 7 of which receives a centering axis 8 solid with the ski. At its rear portion, the binding is extended by a base plate 9 on which the lateral retaining means 10 are arranged. These lateral retaining means are constituted by at least one longitudinal projection 11 along the axis of the ski, the profile of which has the form of an inverted V, intended to cooperate with a correspondingly profiled cavity fashioned in the metatarsal region of the sole. In addition, the rear end 12 of the base plate 9 is restrained in height by a shoulder 13 of a slide 14 which allows it to escape laterally of the two sides of the ski. This lateral escape occurs when, under the effect of torque, the base plate 9 pivots about the centering axis 8 because of the fact that the torque is greater than the retention force produced by the torsional retaining means 15 located forwardly of the hooking region. These torsional retaining means are constituted, for example, by a threaded housing 16 located in the body of the base plate adjacent the housing zone 5 in which is placed a ball 17 on which is supported a compression spring 18 the force of which is controlled by a control screw 19. The ball 17 also ratches itself in a housing 20 provided in the binding plate 8' of the centering axis 8, such that, when the torque, indicated schematically by the arrow 21, exceeds a preselected value, the ball 17 escapes from the said housing 20 and permits the rotation of the base plate 9 to which the boot is fixed, about the said centering axis 8.

Figure 3:
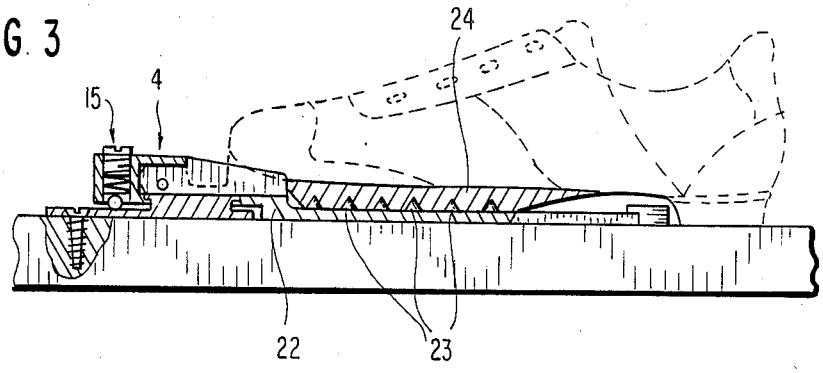
FIG. 3 is a longitudinal sectional view of a second embodiment in which the retention means are replaced by hard points pressing into the sole of the boot.
Figure 4:
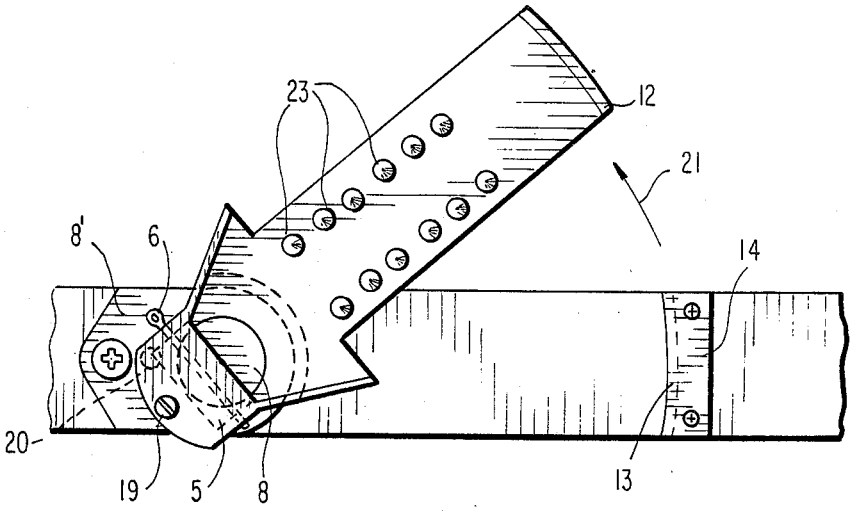
FIG. 4 is a plan view of the second embodiment.

FIGS. 3 and 4 illustrate the same device for binding a boot to a ski according to the invention as the one described hereinabove, with the slight difference that the lateral retaining means are formed in a different manner. In this case, the base plate 22 which extends the rear portion of the binding 4 comprises lateral retaining means constituted by conical points 23 arranged in the region corresponding to the metatarse. These conical points 23, of hard material, insert themselves, under the weight of the skier, in the corresponding soft portion 24 of the sole of the boot. Clearly, the points can equally well be of pyramidal form, and other forms of projection can be used in order to effect the sole-base plate cooperation which assures the lateral retention. The safety functioning of this embodiment remains identical with the one previously described.

Figure 5:
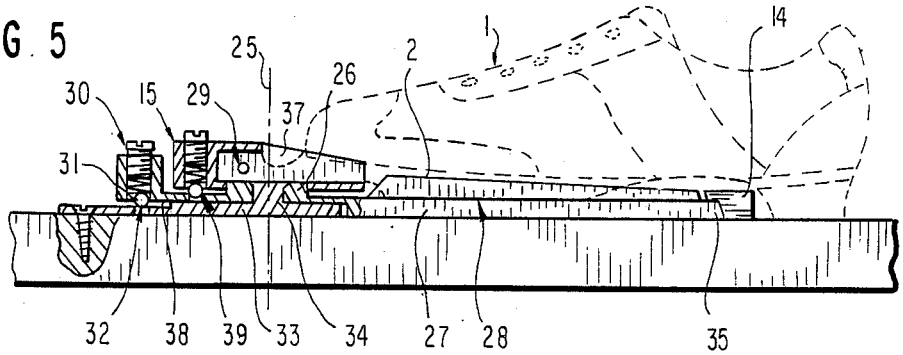
FIG. 5 is a longitudinal sectional view of a third embodiment in which the hooking means and the lateral retention means are centered on the same axis of rotation although movable with respect to one another. In this embodiment, the hooking means and the retaining means each comprise torsional retaining means, respectively for the lateral retaining means with respect to the ski, and for the hooking means with respect to the lateral retaining means.
Figure 6:
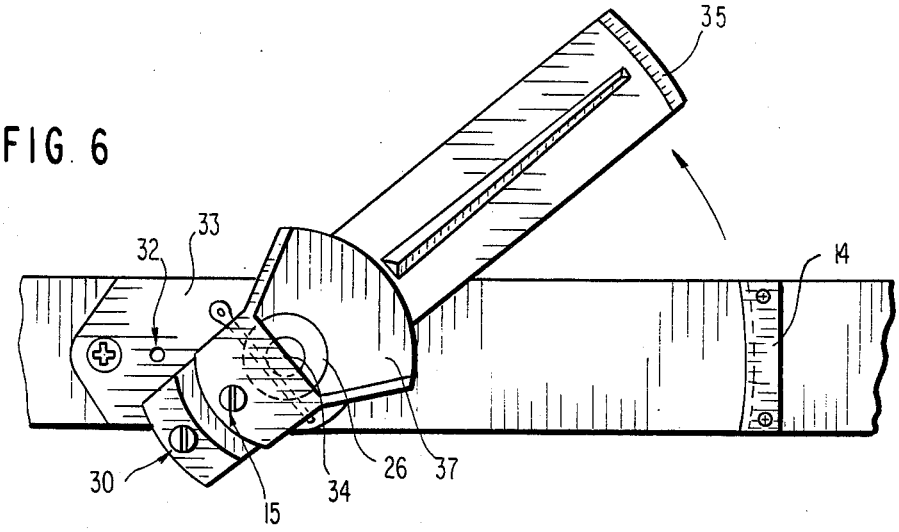
FIG. 6 shows a plan view of the third embodiment in complete release position resulting from torque.
Figure 7:
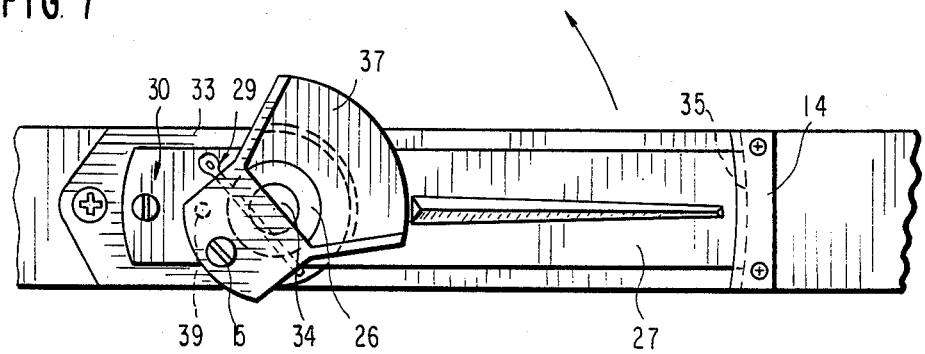
FIG. 7 shows a plan view of the third embodiment in partial release position at the level of the hooking means resulting from torque, while the heel of the boot is completely raised.

In the embodiment according to FIGS. 5 to 7, the boot is connected to the ski by hooking means and lateral retaining means pivotally mounted independently of one another on a common rotational axis 25. This constructional arrangement provides the advantage of assuring the safety of the skier according to the various foot positions in the process of striding. Thus, when the foot rests on the ski, as shown in FIG. 5, in particular during rapid turns with turning steps or herringbone climbing, it is important for the user to be able to effect consecutive safety releases in those foot positions which are subjected to torque. However, the safety of the skier is not limited to the position in which of the foot is resting flat on the ski, but also when the heel is lifted to begin another stride. It will happen that the trail is not in good condition, and the skier has his foot subjected to torque when his heel is raised. As can be seen, the structural arrangement according to FIGS. 5 to 7 responds to the safety requirements in the two cases mentioned. To this effect, the binding device comprises hooking means intended to assure the connection of the boot to the ski, as described in connection with the preceding figures, and pivotally mounted on an axis of rotation 26 extending from the base plate 27, which is provided with torsional retaining means 15 with respect to the said base plate, itself provided with torsional retaining means 30 with respect to the ski. By way of example, these torsional retaining means are composed of a system for controlling the hardness of the ratching of a ball in a housing of the type already described. Thus, the ball 31 of the system for controlling torsional retention of the base plate 27 cooperates with a housing 32 provided in the plate 33 for binding the centering axis 34 fixedly mounted on the ski. This centering axis 34 has the shape of a trunnion on which is pivotally mounted the said base plate, which thus works as a pivoting bearing. As already described, this base plate 27 extends toward the rear of the ski, at least up to the metatarsal region, where it comprises lateral retaining means 28 of the sole 2. The rearward end 35 of the base plate 27 is restrained as to height by an abutment 14 fixed to the ski but allowing lateral escape during torsional release forces passed on by the sole to the said lateral retaining means (FIGS. 6). The forward end of the base plate 27 is thus solid with the ski through the interposition of its bearing 26 turning on the trunnion 34. In addition, the bearing 26 of the said plate comprises a cylindrical shoulder 36 serving in its turn as centering axis for the binding body 37 of which the hooking means 29 are composed. The binding body 37 in which the flexible extension of the sole of the boot is housed also comprises a second system 15 for adjusting the hardness of ratching of a ball 38 in a cavity 39 provided in the base plate 27. There is hence a possibility of release between the binding body 37 and the said base plate 27 (Figure ). This double release device thus enables a safety release when the skier lifts the heel for a new stride, despite the fact that the moment of torque which is applied to the engaged part of the boot is diminished; this corresponds to a suppression in the length of the sole engaged with the lateral retaining means, only the tip of the sole and the forward metatarsal region being, at the maximum extension position of the foot, in cooperation with the said hooking means. Thus, for this type of safety binding for a cross-country ski, the adjustment of the different torsional retaining means is accomplished in such a way that the release levels are higher for the adjustment system acting against the base plate 27 and the ski, than the one between the binding body 37 and the said base plate 27.

Figure 8:
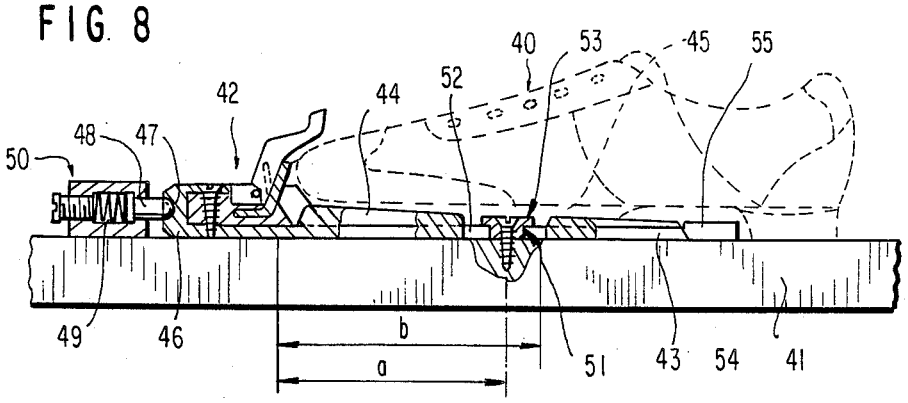
FIG. 8 is a longitudinal sectional view of a fourth embodiment in which the hooking means and the lateral retaining means are made from a single piece releasable from the ski with which it is made solid through locking means located on the ski.
Figure 9:
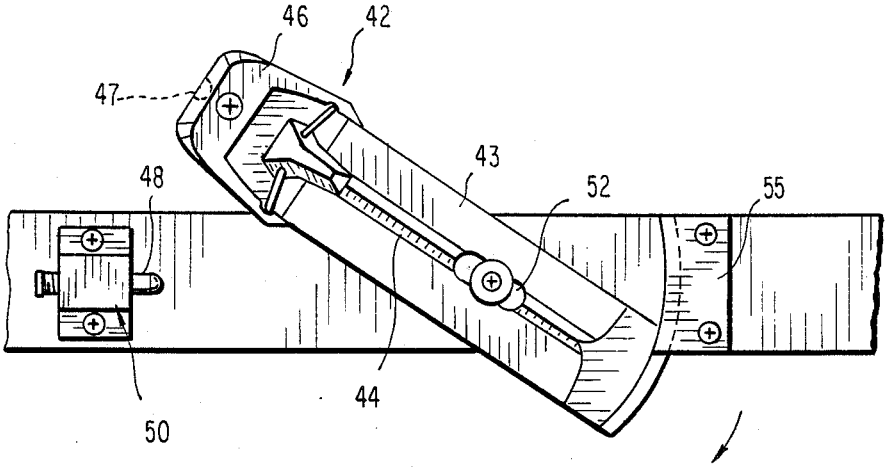
FIG. 9 is a plan view of the fourth embodiment in release position.

Another embodiment according to the invention is shown in FIGS. 8 and 9, where the means for hooking and for lateral retention of the boot are made from a single piece comprising a continuous binding body extended by a base plate. In order to illustrate the versatility of the present invention, this embodiment has been shown with the hooking means different from those of the preceding embodiments. In particular, the binding in question here corresponds to a binding of the type described in French patent application No. 79.02513. However, in the present case, the binding body is not maintained on the ski by screws but by torsional retaining means 50. These torsional retaining means 50 are constituted at the front of the boot by a locking finger 48 with adjustable spring 49 and, according to a particular feature of this embodiment, by a rotational pivot located on the longitudinal axis of the ski at a distance "a" from the hooking means within the limits of the metatarsal regions respectively corresponding to sizes between sizes 35 and 45. These limits are designated by the letter "b" in FIG. 8. This structural arrangement has the advantage of taking account of the plantar support region at one of the most acted upon locations of the boot, since it participates actively in all phases of propulsion support and lateral retention during the striding phase. It is consequently at this location that there is also situated the region most often subjected to torsional forces occurring at the level of the skier's foot, thus requiring release capability when the forces exceed certain allowed limits sufficient to cause injuries to the said skier.

Figure 10:
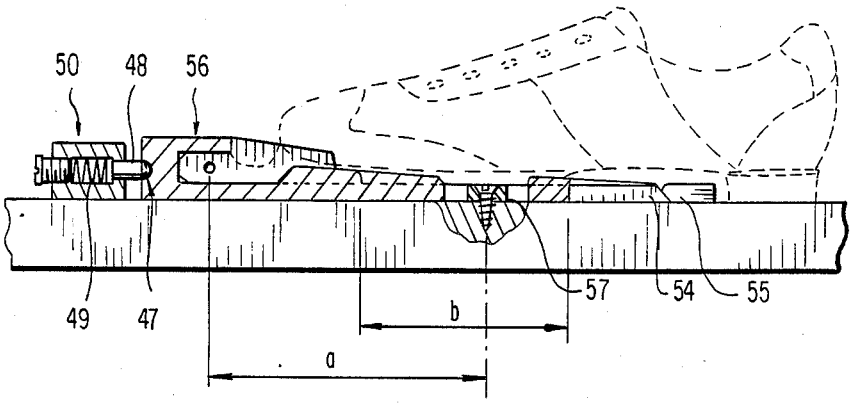
FIG. 10 is a longitudinal sectional view of a fifth embodiment in which the portion of the torsional retaining means located under the metatarsal region does not comprise a vertical retaining shoulder, and thereby enables complete freeing-up of the device upon release.
Figure 11:
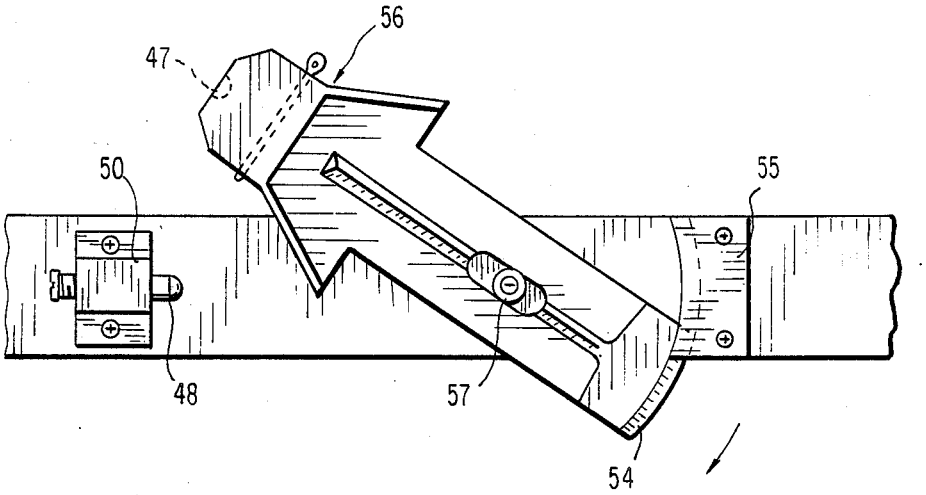
FIG. 11 is a plan view of the fifth embodiment, with the binding in release position.

In FIG. 8, a boot 40 is connected, by its forward end, to a ski 41 by the intermediary of hooking means 42. The same are extended toward the back, at least to the metatarsal region, by a base plate 43 comprising lateral retaining means 44 intended to cooperate with corresponding means arranged in the sole 45 of the said boot. The hooking means 42 comprise a binding body 46 at the forward end of which is provided a release ramp 47 with which cooperates the locking finger 48 acted on by the adjustable force spring 49. Moreover, base plate 43 comprises, approximately at mid-length of the region of placement of the rotational pivot 51 described hereinabove, a corresponding slot 52 in which it comes to be lodged. This slot 52 is defined by an oblong hole, so that, when the forces to which the foot of the skier is subjected exceed the level of the selected adjustment, the said base plate 43 can escape laterally after having pushed back the said locking finger 48 in a slight longitudinal translation. In order that the boot-ski connection is always assured, despite the release position (FIG. 9) of the base plate 43, the rotational pivot 51 is provided with a shoulder 53 extending above the edges of the oblong hole 52. Clearly, it is entirely conceivable, without exceeding the scope of the invention, to provide a base plate which can free itself entirely from the ski in case of release. In this case, the shoulder will not be provided on the rotational pivot. This version is shown in FIGS. 10 and 11 with another type of hooking means 56, the construction of which will be feasible for one skilled in the art without further illustration.

In the two cases represented, it goes without saying that the rear portion of the base plate 54 is restrained as to height by an abutment 55 preventing all vertical displacement.

Figure 12:
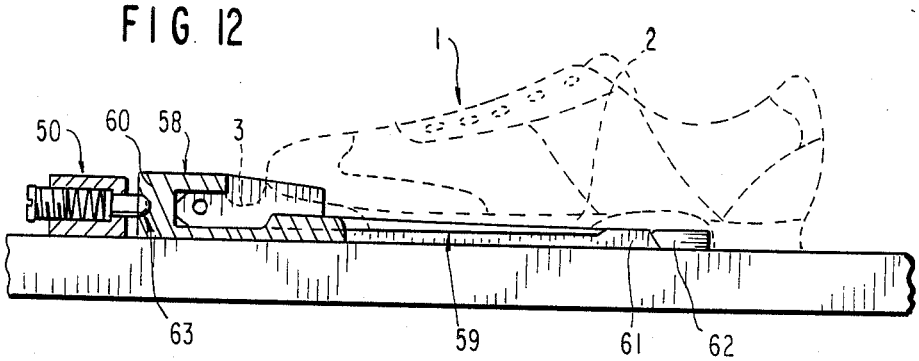
FIG. 12 is a longitudinal sectional view of a sixth embodiment in which the hooking means and the lateral retaining means are made from a single piece completely releasable from the ski with which it is made solid through locking means on the ski.
Figure 13:
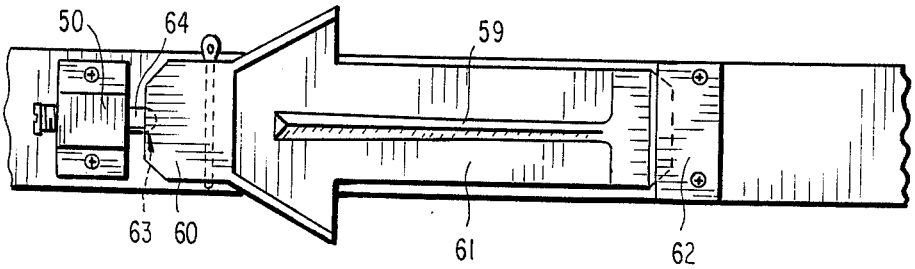
FIG. 13 shows a plan view of the sixth embodiment in position of use.
Figure 14:
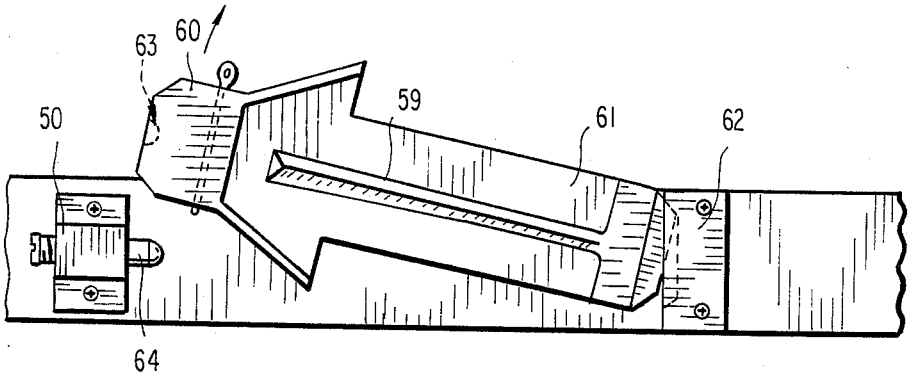
FIG. 14 shows a plan view of the sixth embodiment in release position resulting from torque.

FIGS. 12 to 14 illustrate another embodiment according to the invention comprising hooking means 58 and associated lateral retaining means 59 fully releasable from the ski following pulls at the level of cooperation of the sole 2 with the said lateral retaining means 59 controlled by retaining means 50 upon release. To this end, the flexible extension 3 of the front of the sole of the boot 1 comes to lodge in the binding body 60 of which the hooking means 58 is constituted, as has been described with reference to FIG. 1. Moreover, these hooking means are extended toward the rear in a base plate 61 provided with lateral retaining means 59, restrained as to height by an abutment 62 which has already been mentioned. The front of the hooking means 58 cooperates, through the intermediary of a ramp 63, with a locking finger 64 belonging to the means 50 for retention upon untimely release. FIGS. 12 and 13 show the ski binding device in position of use, while FIG. 14 shows it in ski release position. When, for whatever reason, the ski retransmits the unexpected forces to the foot of the skier, the locking finger is pushed back toward the front of the ski and liberates the ski binding device from its cooperation with it.

Figure 15:
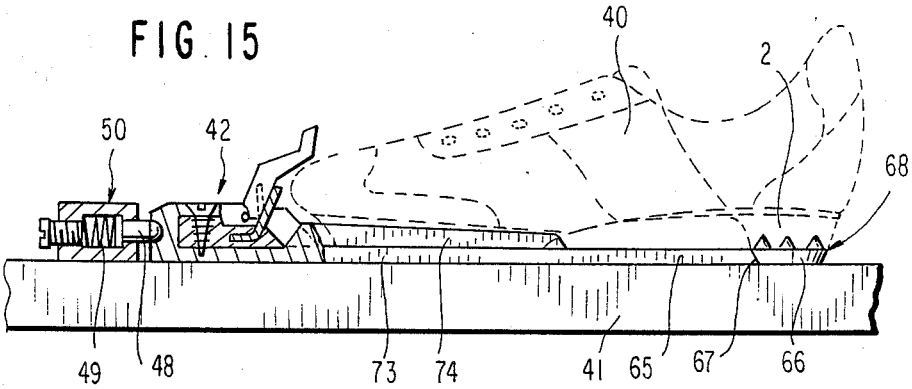
FIG. 15 is a partial longitudinal section view of a seventh embodiment in which the looking means and the lateral retaining means are made of a single piece releasable from the ski with which it is made solid through retaining means comprised, inter alia, of a rotation pivot located approximately at the tibia axis of the skier.
Figure 16:
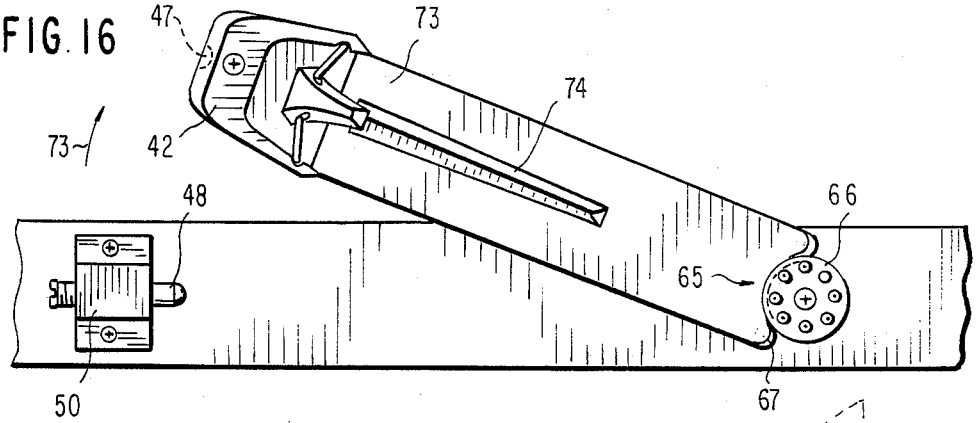
FIG. 16 shows a plan view of the seventh embodiment in release position from the rear pivot of rotation.
Figure 17:
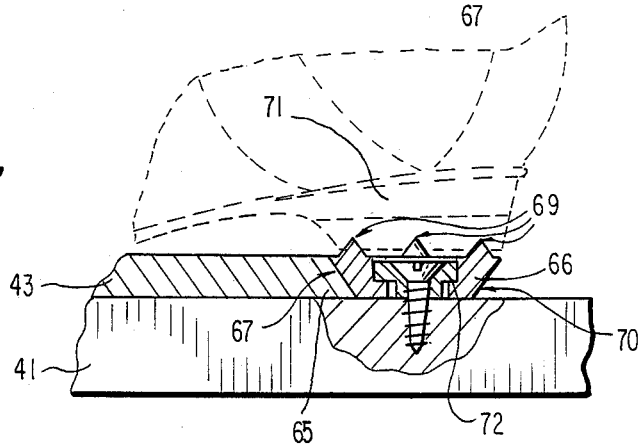
FIG. 17 shows detail section view of the rear pivot of rotation according to FIG. 15.

In FIG. 15, a cross-country ski boot 40 is connected by its forward end to a ski 41 through the intermediary of hooking means 42 of the type described in French application No. 79 02513. The hooking means 42 are extended toward the rear by a base plate 73 which comprises, at least to under the metatarsal region, lateral retaining means 74 for the boot. According to a particular feature of this embodiment, the rearward end 65 of the base plate is restrained as to height by rotating wheel 66 permitting escape of the said plate from each side of the ski 41 according to the releases. The cooperation of the rearward end 64 of the plate with the said wheel 66 is achieved through the intermediary of an inclined ramp 67 the contour of which conforms to the radius of the said wheel 66. This latter is of a conical shape the large base of 68 of which is opposite the sole 2 of the boot, so that the profile of the ramp 67 catches under the truncated cone portion 70 of the said pivot. Preferably, this large base 68 is provided with points 69 intended to penetrate into the relatively soft material of the heel piece 71 of the sole, so as to assure the best possible cooperation when the foot comes to rest flat on the ski (FIG. 17). In order to assure a rotation about the axis of the tibia (approximately in the extension of the heel), the wheel 66 is mounted for free rotation on a bearing 72 fixed to the ski. At the front of the hooking means 42 is provided a locking device 50 intended to retain the hooking means/lateral retaining means assembly in position of use on the ski. As already described with regard to FIG. 8, the locking device 50 comprises a locking finger 48 acted upon by a compression spring 49. When the forces at the level of the boot connected to the ski by the device according to the invention become too great, the locking finger 48 draws back under the effect of these forces and frees the said base plate 43. According to the nature of the forces brought to bear on the said safety binding device, the base plate can be freed up in the case of backward falls. FIG. 16 shows the case of a torque safety release indicated schematically by arrow 73. In this representation, the locking finger 48 is subjected to torque exceeding the selected degree of adjustment of the spring 49, and the boot, joined to the means for hooking and for lateral retention, is freed from the locking device 50 by its forward end. The sole being flat on the ski, the heel 71 of the latter is in engagement with the points 69 on the upper surface 68 of the wheel 66, the same pivoting about the axis of bearing 72. When the boot reaches a position such that it no longer has support on the ski (FIG. 16), it disengages its connection with the said points 69 of the wheel, and the boot-base plate assembly swings to the side of the ski, permitting ramp 67 to escape from its cooperation with the conical surface 70 of the wheel.

Although the invention has been described in connection with different particular embodiments, it is clear that it is in no way limited to these, and that numerous variants and modifications can be made therein, as, for example, hooking means using bindings of known type (norm 75, 50, Adidas type, etc.), without departing from its or its.

I claim:

1. An assembly for binding a boot having a heel and a sole to a ski intended for the practice of cross-country skiing, said assembly comprising a safety binding device comprising attaching means for maintaining the forward end of said boot on said ski while allowing elevation of said heel, said assembly further comprising means for lateral retention of said boot on said ski positioned in the metatarsal region of a foot inserted in said boot for cooperation with said sole, wherein said means for lateral retention are rigidly affixed to said attaching means, so as to form one continuous piece with said attaching means, said assembly further comprising torsional retention means for torsionally retaining said attaching and lateral retention means, wherein said attaching and lateral retention means are releasable at least laterally with respect to said ski about at least one axis of rotation against the bias of said torsional retention means whatever the elevation of said heel of said boot with respect to said ski.

2. The assembly according to claim 1, wherein said lateral retention means and said attaching means form a single piece adapted to be rotated about an axis perpendicular to said ski.

3. The assembly according to claim 2, wherein said perpendicular axis is located forwardly of said attaching means, and said torsional retention means are adjustable.

4. The assembly according to claim 3, wherein said single piece comprising said lateral retention means and said attaching means comprises a binding device, said binding device further comprising a base plate comprising vertical guide portions, said base plate extending to the rear beyond said vertical guide portions into said metatarsal region, said binding device further comprising a stop abutment and a slide, said binding device being maintained vertically on said ski at the level of said axis of rotation by said stop abutment and at the level of a rear end of said base plate by said slide, wherein said torsional retention means are located at the front of said binding device.

5. The assembly according to claim 2, wherein said perpendicular axis is located in a zone corresponding approximately to said metatarsal region of the foot.

6. The assembly according to claim 5, wherein said single piece comprising said lateral retention means and said attaching means comprises a binding device comprising a base plate, said base plate comprising vertical guide portions, said base plate extending to the rear beyond said vertical guide portions into said metatarsal region, said binding device further comprising a stop abutment and a slide, said binding device being maintained vertically for any position on said ski, at the level of said axis of rotation by said stop abutment and at the level of a rear end of said base plate by a slide, wherein said torsional retention means are located at the front of said binding device.

7. The assembly according to claim 5, wherein said single piece comprising said lateral retention means and said attaching means comprises a binding device comprising a base plate comprising vertical guide portions, and a slide, said base plate of said binding device extending to the rear beyond said vertical guide portions into said metatarsal region, said binding device being maintained vertically on said ski by said torsional retention means located at the front thereof and at the level of a rear end of said base plate by said slide.

8. The assembly according to claim 2, wherein said perpendicular axis is located approximately in the region of said heel of said boot.

9. The assembly according to claim 8, wherein said single piece comprising said lateral retention means and said attaching means comprises a binding device, said binding device comprising a base plate comprising lateral guide portions and a ramp, said base plate of said binding device extending to the rear beyond said lateral guide portions from the tip of said sole to within said metatarsal region, said binding device being maintained vertically on said ski at the level of said torsional retention means located at the front of said device, and at the level of the rear end of said base plate by said ramp.

10. The assembly according to claim 9, wherein said ramp comprises a frusto-conical wheel rotatable about said axis, said wheel having its smaller base facing the surface of said ski and its larger base comprising points facing said sole of said boot.

11. The assembly according to claim 1, wherein said lateral retention means and said attaching means form a single piece pivotable about an instantaneous center of rotation located at the rear of said single piece.

12. The assembly according to claim 11, wherein said single piece comprising said lateral retention means and said attaching means comprises a binding device comprising a base plate comprising vertical guide portions and a ramp, said base plate of said binding device extending to the rear beyond said vertical guide portions into said metatarsal region, said binding device being maintained vertically on said ski by said torsional retention means located at the front thereof and at the level of rear end of said base plate by said ramp.

13. The assembly defined by claim 1 wherein said attaching and lateral retention means comprises means for permitting elevation of the heel when said one continuous piece is aligned and unaligned with said ski.

14. An assembly for holding a boot having a heel and a sole to a ski, said assembly comprising:

(a) means for attaching the front end of the boot to said ski while permitting the elevation of the heel off of said ski;

(b) means for laterally retaining the boot against lateral pivoting with respect to the ski, wherein said lateral retaining means is positioned in the metatarsal region of a foot inserted in said boot, wherein said lateral retaining means is adapted to cooperate with the sole of said boot; and (c) means for permitting lateral pivoting of said boot to a plurality of positions whatever the elevation of said heel of said boot with respect to said ski, wherein said lateral retaining means, and said attaching means together comprise: means for permitting the heel to be raised above said ski when said heel laterally pivots to said plurality of positions, and means for laterally retaining said heel at the level of the top of the ski against further lateral pivoting from one of said plurality of positions during lateral pivoting of said boot to said plurality of positions.

15. The assembly according to claim 1, wherein said lateral retention means and said attaching means form a two-part assembly connected by means of said torsional retention means, said two-part assembly being rotatable about an axis perpendicular to said ski.

16. The assembly according to claim 15, wherein said attaching means are independently rotatable about said axis in relation to said lateral retention means against the bias of said torsional retention means.

17. The assembly according to claim 15, wherein said perpendicular axis is located forwardly of said attaching means.

18. The assembly according to claim 17, wherein said lateral retention means comprises a base plate, wherein said two-part assembly comprises a stop abutment and a rear slide, wherein said two-part assembly is vertically maintained on said ski at the level of said axis of rotation by said stop abutment, and at the level of a rear end of said base plate by said rear slide wherein said assembly further comprises additional torsional retention means located at the front of said two-part assembly.

19. The assembly defined by claim 14 wherein said lateral retention means comprises means for laterally retaining said boot in response to displacing the heel of said boot downwardly toward said ski.

20. The assembly defined by claim 19 further comprising an element pivotally attached to said ski about a substantially vertical axis so as to laterally pivot with respect to said ski, wherein said attaching and lateral retention means are attached to said element.

21. The assembly defined by claim 20 wherein said element comprises a plate.

22. The assembly defined by claim 20 further comprising torsional retaining means for torsionally retaining and biasing said element against lateral pivoting, wherein said torsional retaining means releases said element to permit lateral pivoting in response to the application of an external force to said assembly that is larger than said bias of said torsional retaining means whatever the elevation of the heel of said boot.

23. The assembly defined by 22 wherein said attaching and lateral retention means comprise means for permitting elevation of the heel when said element is aligned and unaligned with respect to said ski.

24. The assembly according to one of claims 5–12 and 15–18, wherein said lateral retention means comprises said base plate and projecting profiles adapted to cooperate with corresponding recess profiles in said sole, said projecting profiles extending over the entire length of said base plate.

25. The assembly according to one of claims 5–12 and 15–18, wherein said sole comprises a portion softer than the rest of said sole, wherein said lateral retention means comprises base plate and hard points located on said base plate for penetration into said softer portion of said sole.

26. The assembly according to one of claims 1 to 12, wherein said binding device comprises a body, wherein said torsional retention means comprises a spring and at least one ball locking device acted upon by said spring located in the body of said binding device.

27. An assembly for binding a boot having a heel and a sole to a ski intended for the practice of cross-country skiing, said assembly comprising a safety binding device comprising attaching means for maintaining the forward end of said boot on said ski while allowing elevation of said heel, said assembly further comprising means for lateral retention of said boot on said ski for cooperation with said sole, wherein said means for lateral retention are rigidly affixed to said attaching means, so as to form one continuous piece with said attaching means, said assembly further comprising torsional retention means for torsionally retaining said attaching and lateral retention means, wherein said attaching and lateral retention means are releasable at least laterally with respect to said ski about at least one axis of rotation against the bias of said torsional retention means whatever the elevation of said heel of said boot with respect to said ski, wherein said lateral retention means and said attaching means form a single piece adapted to be rotated about an axis perpendicular to said ski, said axis being located forwardly of the metatarsal region, and wherein said single piece comprising said lateral retention means and said attaching means comprises a binding device, said binding device further comprising a base plate comprising vertical guide portions, said base plate extending to the rear beyond said vertical guide portions into the metatarsal region, said binding device further comprising a slide, said binding device being maintained vertically on said ski at the level of rear end of said base plate by said slide, and wherein said torsional retention means are located at the front of said binding device.

28. The assembly according to claim 27, wherein said lateral retention means comprises said base plate and projecting profiles adapted to cooperate with corresponding recess profiles in said sole, said projecting profiles extending over the entire length of said base plate.

29. The assembly according to claim 27, wherein said sole comprises a portion softer than the rest of said sole, wherein said lateral retention means comprises a base plate and hard points located on said base plate for penetration into said softer portion of said sole.

30. An assembly for binding a boot having a heel and a sole to a ski intended for the practice of cross-country skiing, said assembly comprising a safety binding device comprising attaching means for maintaining the forward end of said boot on said ski while allowing elevation of said heel, said assembly further comprising means for lateral retention of said boot on said ski positioned in the metatarsal region of a foot inserted in said boot for cooperation with said sole, wherein said means for lateral retention are rigidly affixed to said attaching means, so as to form one continuous piece with said attaching means, said assembly further comprising torsional retention means for torsionally retaining said attaching and lateral retention means, wherein said attaching and lateral retention means are releasable at least laterally with respect to said ski about at least one axis of rotation against the bias of said torsional retention means whether or not said heel of said boot is elevated with respect to said ski, and whatever the elevation of said heel of said boot with respect to said ski, wherein said axis is located forwardly of the metatarsal region, wherein said single piece comprising said lateral retention means and said attaching means comprises a binding device, said binding device further comprising a base plate comprising vertical guide portions, said base plate extending to the rear beyond said vertical guide portions into the metatarsal region.

* * * * *

UNITED STATES PATENT AND TRADEMARK OFFICE

CERTIFICATE OF CORRECTION

PATENT NO. : 4,792,156

DATED : December 20, 1988

INVENTOR(S) : Jean HUE

It is certified that error appears in the above-identified patent and that said Letters Patent is hereby corrected as shown below:

On the title page:

Item [30], change the priority document date from "August 4, 1982" to —April 8, 1982—.

At column 1, line 63, change "a" to —at—.

At column 2, line 54, change "looking" to —locking—.

At column 4, line 44, change "FIGS. 6" to —FIG. 6—.

At column 4, line 55, change "(Figure)" to —(Figure 7)—.

At column 7, line 16, change "its or its." to —its scope or its spirit—.

Signed and Sealed this

Twenty-third Day of July, 1991

*Attest:*

*Attesting Officer*

HARRY F. MANBECK, JR.

*Commissioner of Patents and Trademarks*